US009926793B2

(12) United States Patent
Bogue et al.

(10) Patent No.: US 9,926,793 B2
(45) Date of Patent: Mar. 27, 2018

(54) BLADES AND MANUFACTURE METHODS

(71) Applicant: United Technologies Corporation

(72) Inventors: William Bogue, Hebron, CT (US); Timothy J. Tabor, Vernon, CT (US); Joseph J. Parkos, Jr., East Haddam, CT (US)

(73) Assignee: United Technologies Corporation, Farmington, CT (US)

( * ) Notice: Subject to any disclaimer, the term of this patent is extended or adjusted under 35 U.S.C. 154(b) by 352 days.

(21) Appl. No.: 14/774,420

(22) PCT Filed: Mar. 11, 2014

(86) PCT No.: PCT/US2014/023054

§ 371 (c)(1),
(2) Date: Sep. 10, 2015

(87) PCT Pub. No.: WO2014/150362

PCT Pub. Date: Sep. 25, 2014

(65) Prior Publication Data

US 2016/0017725 A1 Jan. 21, 2016

Related U.S. Application Data

(60) Provisional application No. 61/789,734, filed on Mar. 15, 2013.

(51) Int. Cl.
*C23C 4/02* (2006.01)
*F01D 5/28* (2006.01)
(Continued)

(52) U.S. Cl.
CPC ..... *F01D 5/288* (2013.01); *C23C 4/02* (2013.01); *C23C 4/11* (2016.01); *C23C 4/134* (2016.01);
(Continued)

(58) Field of Classification Search
CPC . F01D 5/288; F01D 5/20; F01D 11/12; F01D 11/122; F01D 11/125; F01D 11/08;
(Continued)

(56) References Cited

U.S. PATENT DOCUMENTS 3,144,349 A 8/1964 Swingler et al.
3,758,233 A 9/1973 Cross et al.
(Continued)

FOREIGN PATENT DOCUMENTS

EP 1652601 A2 5/2006
JP S58192949 A 11/1983

OTHER PUBLICATIONS

International Search Report and Written Opinion for PCT/US2014/023054, dated Aug. 26, 2014.
(Continued)

*Primary Examiner* — Richard Edgar
(74) *Attorney, Agent, or Firm* — Bachman & LaPointe, P.C.

(57) ABSTRACT

A blade (100) has an airfoil (106) having a leading edge (114), a trailing edge (116), a pressure side (118), and a suction side (120) and extending from an inboard end (110) to a tip (112). An attachment root (108) is at the inboard end. The blade comprises an aluminum alloy substrate (102) and a coating at the tip (130). The coating (130) comprises an anodic layer (160) atop the substrate and an aluminum oxide layer (162) atop the anodic layer.

16 Claims, 4 Drawing Sheets

(51) Int. Cl.

| | |
|---|---|
| ***C25D 11/18*** | (2006.01) |
| ***F01D 11/08*** | (2006.01) |
| ***C23C 28/04*** | (2006.01) |
| ***C25D 11/04*** | (2006.01) |
| ***C25D 11/02*** | (2006.01) |
| ***C23C 4/11*** | (2016.01) |
| ***C23C 4/134*** | (2016.01) |
| *C25D 11/08* | (2006.01) |
| *C25D 11/10* | (2006.01) |

(52) U.S. Cl.
CPC ..... *C23C 28/04* (2013.01); *C25D 11/022* (2013.01); *C25D 11/04* (2013.01); *C25D 11/18* (2013.01); *F01D 11/08* (2013.01); *C25D 11/08* (2013.01); *C25D 11/10* (2013.01); *F05D 2220/36* (2013.01); *F05D 2230/31* (2013.01); *F05D 2230/312* (2013.01); *F05D 2240/307* (2013.01); *F05D 2300/121* (2013.01)

(58) Field of Classification Search
CPC .. C23C 4/11; C23C 4/134; C23C 4/02; C23C 28/04; C25D 11/022; C25D 11/04; C25D 11/18; C25D 11/08; C25D 11/10; F05D 2220/36; F05D 2230/31; F05D 2230/312; F05D 2240/307; F05D 2300/121
See application file for complete search history.

(56) References Cited

U.S. PATENT DOCUMENTS

| | | | | |
|---|---|---|---|---|
| 6,190,124 | B1 | 2/2001 | Freling et al. | |
| 2006/0269759 | A1 | 11/2006 | Bayer et al. | |
| 2007/0261965 | A1 | 11/2007 | Heller et al. | |
| 2009/0120101 | A1 | 5/2009 | Lomasney et al. | |
| 2011/0177358 | A1 | 7/2011 | Horton et al. | |
| 2012/0121431 | A1 | 5/2012 | Jakimov et al. | |
| 2014/0116883 | A1* | 5/2014 | Xiong | C25D 11/04 205/50 |

OTHER PUBLICATIONS

Technical Process Bulletin, Mar. 1, 2007, Henkel Surface Technologies, Madison Heights, Michigan.
European Search Report for Application No. 14769262.8, dated Oct. 26, 2016.

* cited by examiner

BLADES AND MANUFACTURE METHODS

CROSS-REFERENCE TO RELATED APPLICATION

Benefit is claimed of U.S. Patent Application Ser. No. 61/789,734, filed Mar. 15, 2013, and entitled "Blades and Manufacture Methods", the disclosure of which is incorporated by reference herein in its entirety as if set forth at length.

BACKGROUND

The disclosure relates to turbine engines. More particularly, the disclosure relates to aluminum surfaces, including aluminum blades in turbine engines requiring increased hardness for wear or rub surfaces.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

In an exemplary gas turbine engine, more particularly, a turbofan engine, coatings on the blade tips of fan blade stages may be used to interface with the surrounding case.

Blade tips can rub on an abradable material to minimize growth of tip clearances by removing stock from the abradable in the process.

The tip of the blade may also experience some wear. Application of a tip coating will increase the durability of the tip. The thicker the coating, the greater the time between repair at the tip for wear plus there would be a reduction of the temperature at the coating to metal interface.

SUMMARY

One aspect of the disclosure involves a blade having an airfoil having a substrate having a leading edge, a trailing edge, a pressure side, and a suction side and extending from an inboard end to a tip. An attachment root is at the inboard end. The blade comprises an aluminum alloy substrate and a coating at the tip. The coating comprises an anodized layer atop the substrate and an aluminum oxide layer atop the anodized layer.

In one or more embodiments of any of the foregoing embodiments, the substrate is an outer layer and the blade further has an inner layer In one or more embodiments of any of the foregoing embodiments, the substrate comprises 7XXX or 2XXX-series, the anodic layer has a characteristic thickness of at least 10 micrometers, and the aluminum oxide layer has a characteristic thickness of at least 50 micrometers and has lower density and greater porosity than the anodic layer.

In one or more embodiments of any of the foregoing embodiments, the anodic layer has a characteristic thickness of 25-75 micrometers and the aluminum oxide layer has a characteristic thickness of 75-400 micrometers.

In one or more embodiments of any of the foregoing embodiments, the airfoil has an erosion coating away from the tip.

In one or more embodiments of any of the foregoing embodiments, the coating consists of the aluminum oxide layer and the anodic layer.

In one or more embodiments of any of the foregoing embodiments, the aluminum oxide layer is directly atop the anodized layer and the anodic layer is directly atop the substrate.

Another aspect of the disclosure involves a method for manufacturing the blade. The method comprises applying the anodic layer and applying the aluminum oxide layer.

In one or more embodiments of any of the foregoing embodiments, the applying the anodic layer comprises a hard anodize and the applying the aluminum oxide layer comprises spraying.

In one or more embodiments of any of the foregoing embodiments, the applying the anodic layer comprises a hard anodize and the applying the aluminum oxide layer comprises thermal spraying.

In one or more embodiments of any of the foregoing embodiments, the thermal spraying comprises plasma spraying.

In one or more embodiments of any of the foregoing embodiments, the method further comprises peening performed prior to applying the anodic layer.

Another aspect of the disclosure involves a method comprising providing an aluminum alloy substrate, anodic coating the substrate, and thermal spraying an aluminum oxide layer atop the anodic layer.

In one or more embodiments of any of the foregoing embodiments, the substrate is a gas turbine engine component.

In one or more embodiments of any of the foregoing embodiments, the anodic coat comprises a brush anodizing.

In one or more embodiments of any of the foregoing embodiments, the brush anodizing is a local anodizing of a repair region.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
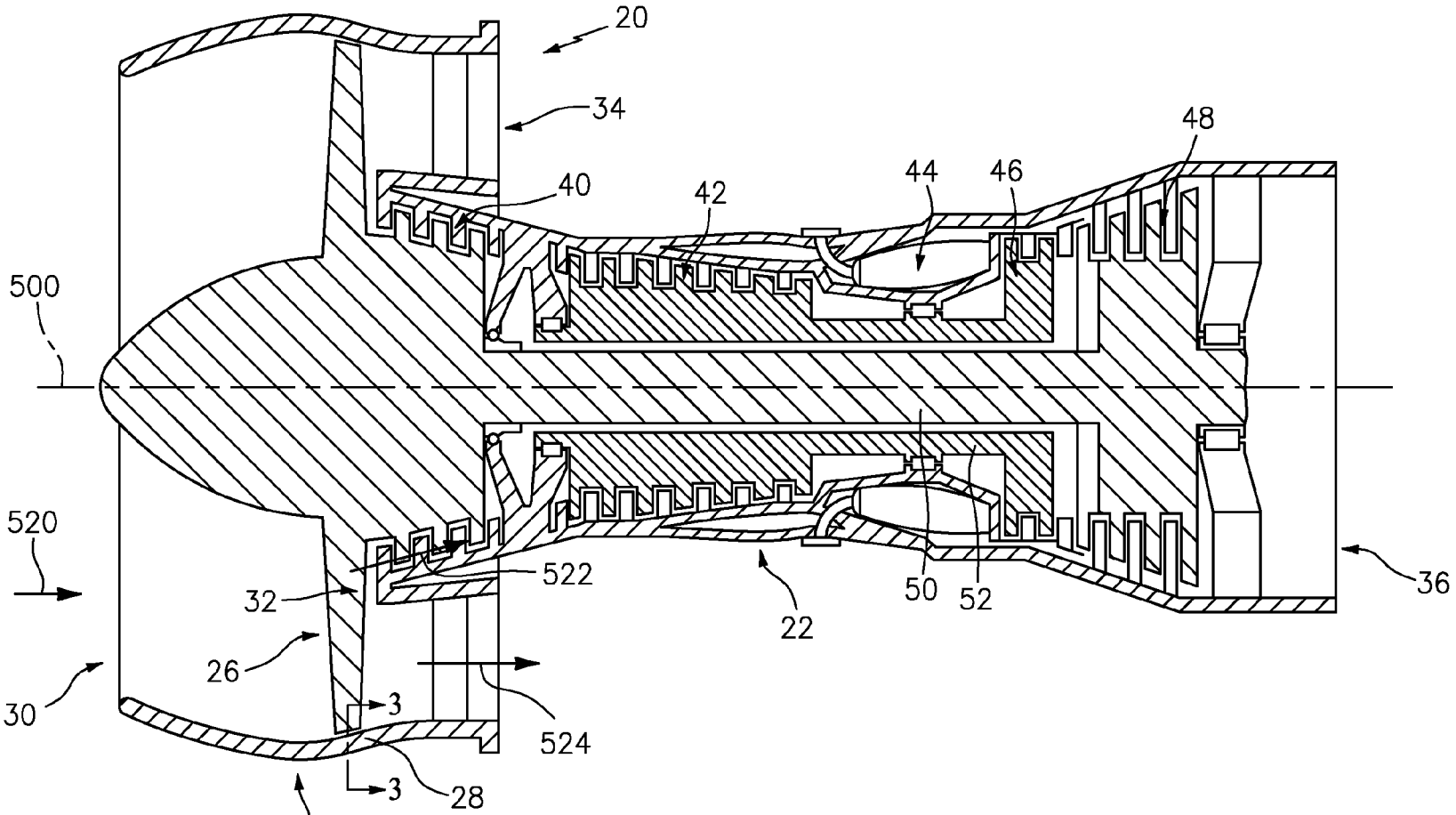
FIG. 1 (PRIOR ART)
FIG. 1 is a partially schematic sectional view of a turbofan engine.
Figure 2:
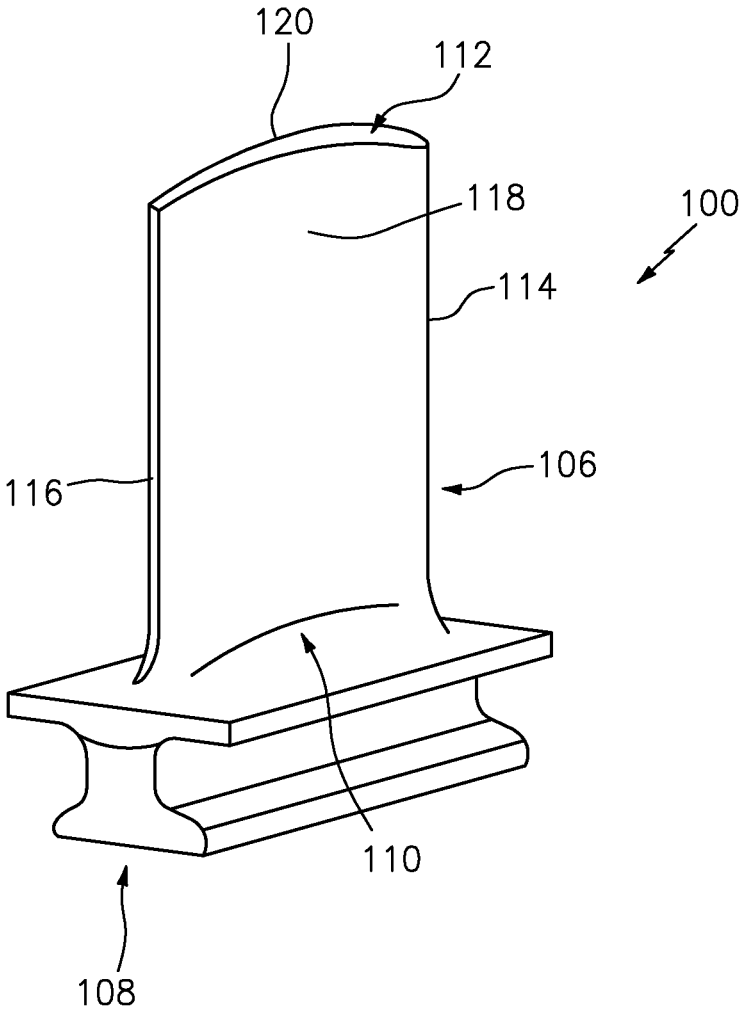
FIG. 2 is an isolated view of the fan blade.
Figure 3:
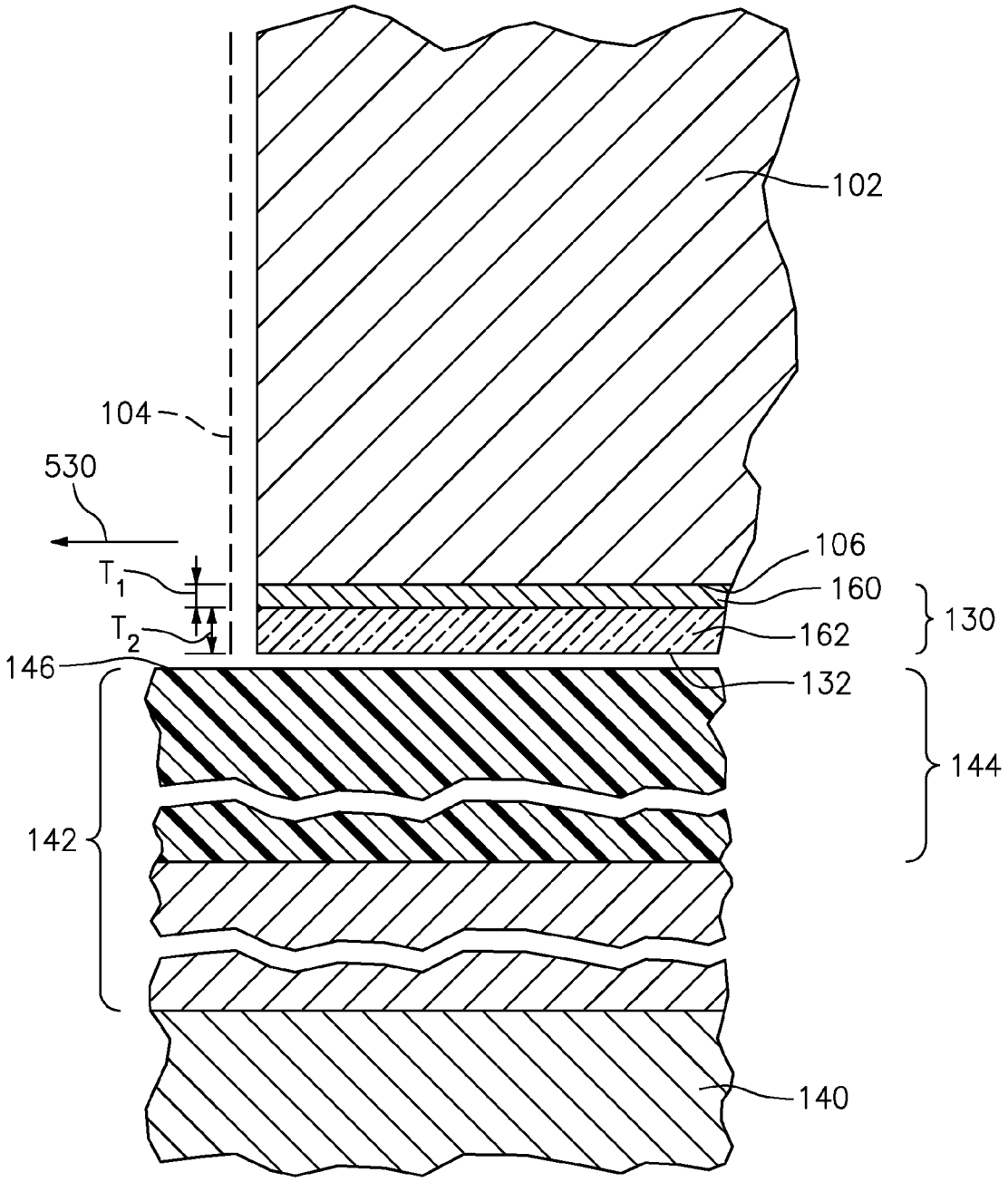
FIG. 3 is an enlarged transverse cutaway view of a fan blade tip region of the engine of FIG. 1 taken along line 3-3 and showing a first rub coating.

FIG. 3 shows a cutaway blade (e.g., fan or compressor) 100 showing a blade substrate (e.g., an aluminum alloy) 102 and, optionally, a polymeric coating 104 (e.g., a polyurethane-based coating) on portions of the substrate. The exemplary substrate comprises an airfoil 106 (FIG. 2) and an attachment feature (e.g., root such as a dovetail or fir tree) 108. The airfoil extends spanwise from a first end 110 (a proximal end) near the root to a second end 112 (a distal end or a free tip). The airfoil has a leading edge 114, a trailing edge 116, a pressure side 118 and a suction side 120. Other features such as a platform and mid-span shrouds or other features may be present. Exemplary substrate material is commercially pure aluminum or 7xxx series or 2xxx series alloys. If there is desire to apply this to non-aluminum parts one can coat the part with aluminum (e.g., commercially) pure.

The exemplary coating 104 is along pressure and suction sides and spans the entire lateral surface of the blade airfoil between the leading edge and trailing edge. The exemplary polymeric coating 104, however, is not on the blade tip 106. A hard coating system 130 is at least along the tip 112 so that its outboard surface defines the tip 132 of the blade. If the polymeric coating is originally applied to the tip 132, it may have been essentially worn off during rub. Circumferential movement in a direction 530 is schematically shown.

FIG. 3 also shows an overall structure of the fan case facing the blade. This may include, in at least one example, a structural case 140. It may also include a multi-layer liner assembly 142. An inboard layer of the liner assembly may be formed by a rub material 144. The exemplary rub material 144 has an inboard/inner diameter (ID) surface 146 facing the blade tips 132 and positioned to potentially rub with such tips during transient or other conditions.

The exemplary hard coating 130 is a multi-layer coating having a first layer 160 and a second layer 162 atop the first layer. The first layer has a thickness $T_1$ and the second layer has a thickness $T_2$. Exemplary $T_1$ is 25-75 micrometers, more broadly, 10-100 micrometer of which approximately one half progresses inward from the original machined aluminum surface. Exemplary $T_2$ is substantially greater than $T_1$ (e.g., at least 200% of $T_1$, more particularly 200-1000% or 300-500% of $T_1$. Exemplary $T_2$ is 75-400 micrometers, more broadly, 50-500 micrometer (this layer is purely additive above the first layer 160 thickness). These thicknesses may be single point local thicknesses or average (mean, median, or mode over the whole tip or other relevant area).

The first layer 160 is an anodized layer formed by controlled electrolytic conversion of the aluminum substrate material. The exemplary second layer 162 is directly atop the first layer and is formed via spray of aluminum oxide-based material (e.g., a thermal spray process such as air plasma spray). The second layer may thus consist essentially of aluminum oxide (e.g., with additives typical of those used in spray powders).

While the anodize and the thermal sprayed aluminum oxide layer 162 have hardnesses and wear properties desirable for the blade tip cutting or wearing into the abradable, the thermally sprayed coating can be applied much thicker than the anodize layer. As a result, the thermal insulation benefit of the aluminum oxide is magnified. Thus, the effective temperature increase from frictional heating at the cutting or wear surface is reduced relative to just an anodized layer. This reduces the temperature of the base aluminum where the polymeric coating 104 is applied. The use of thermally sprayed AlOx is typically limited by residual stresses from the coating and from thermal coefficient of expansion differences between the substrate and the coating. In the proposed process, anodized layer 160 helps buffer thermal-mechanical stresses between the aluminum oxide layer and the aluminum substrate. Being chemically bonded, the adherence of the anodize is superior to that of thermally sprayed coating which is predominantly bonded mechanical means. Frequently, aluminum oxide thermal spray is preceded with a bond coat to absorb these stresses, but because the bond coat is usually noble to the aluminum, the aluminum is subject to galvanic corrosion risks. Aluminum is not subject to galvanic corrosion from aluminum oxide or anodize.

Figure 4:
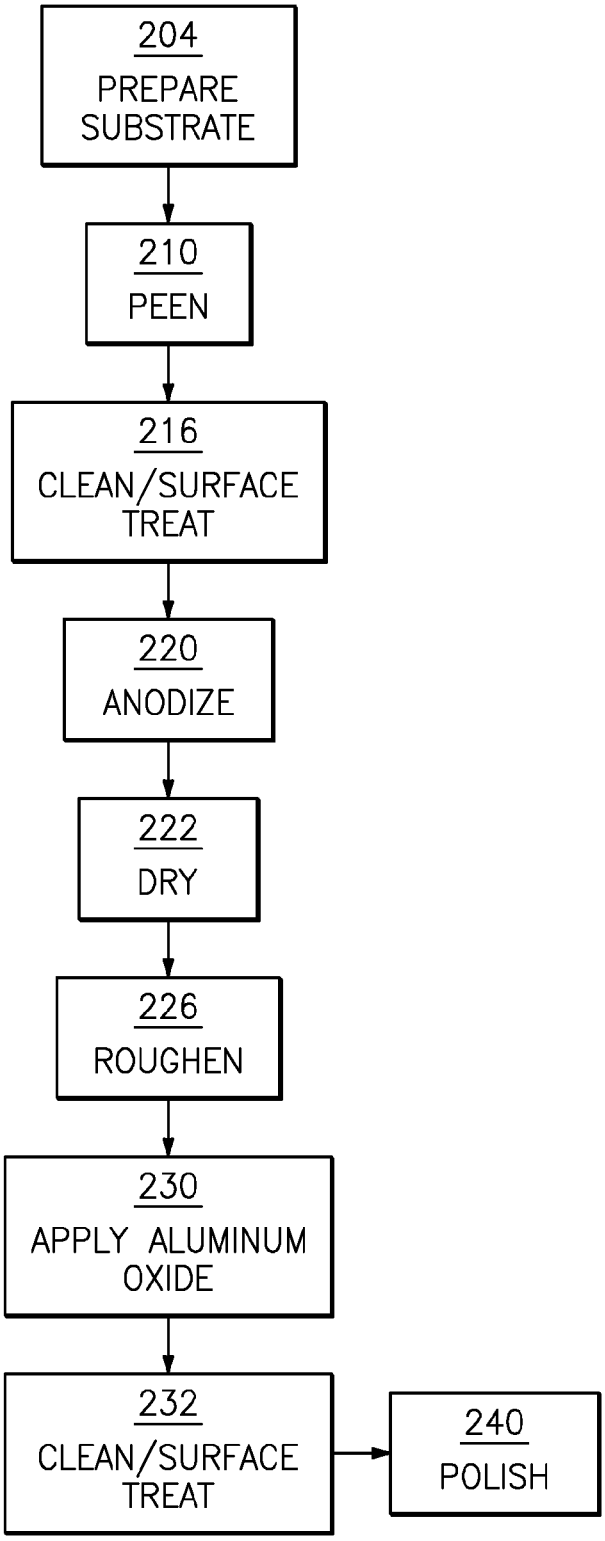
FIG. 4 is a manufacture flowchart.

In an exemplary method of manufacture 202 (FIG. 4), the substrate may be prepared 204. This may comprise machining from a single piece or machining as several pieces followed by assembling and securing such as via diffusion bonding, welding, or the like. If an assembly, there may be a post-assembly machining. In repair situations, there may be other or additional steps including full or local removal of existing coatings, patch application, or the like.

Although the example given above is a full aluminum blade, other potentially relevant materials include composites (e.g., having an aluminum outer layer but other metallic or non-metallic inner layers or other regions such as titanium leading edges).

In the exemplary embodiment, either before or after any such assembly the blade or its key aluminum components may be peened 210. The peening imparts a residual stress. As is discussed below, the use of an anodic initial layer may insulate the substrate from heating during the deposition of a thermal spray second layer so as to preserve the residual stress distribution of the peening.

Although the example involves a blade surface which may rub or cut into an abradable surface, other examples include repair or initial coating of a V-groove or slot as disclosed in U.S. Patent Application Ser. No. 61/769,587, filed Feb. 26, 2013.

One or more cleaning (chemical, mechanical, and/or mere rinsing) and/or surface treatment (e.g., roughening such as by etching, abrading with an abrasive pad or abrasive paper, or grit blasting) stages may follow.

The anodized layer may then be applied by an anodization process 220. An exemplary anodization process may be a sulfuric/oxalic acid anodization AMS 2468/2469 hard anodize. Another chrome-free anodization is the $EC^2$ process of Henkel Technologies, Madison Heights, Mich. $EC^2$ is not a traditional anodize process. Anodize (hard coat) consumes part of the substrate (Al) and combines with the oxygen being generated to form aluminum oxide. $EC^2$ forms titanium oxide (e.g., $TiO_2$) or zirconium oxide at the surface without consuming much substrate. U.S. Patent Application Publication 2005/0061680A1 of Dolan does refer to the process as anodizing.

The process (hard anodize or $EC^2$ plus plasma applied coating) may be used in repair or OEM manufacture. Generically, these processes may be characterized as anodic processes producing anodic coatings.

The exemplary anodizations are tank anodizations. However, alternative brush-applied anodization may, in some embodiments, have specific utility as an underlayer. In many instances, a brush anodization leaves a rough surface which is not desirable as a final surface. However, this roughness may provide beneficial adhesion of a further layer such as the thermal sprayed layers. A brush anodization may have a higher thickness growth rate and thus be faster than a tank anodization. A brush anodization may also be particularly appropriate in a repair situation.

In an exemplary repair situation, the substrate already has an existing coating including at least an anodized layer. At a damage or wear site, the anodized layer may be locally removed (e.g., by machining) to leave a machined aluminum surface. Brushing may, in some embodiments, be particularly useful for locally converting the machined aluminum surface. The exemplary brush anodizing comprises fixturing the part above a tank of electrolyte. The electrolyte is pumped through a wand having graphite cathode covered with a material such as a gauze to retain the electrolyte. The wand is then used to rub (brush) the electrolyte-laded gauze over the part with the electrolyte providing an electrical path between the part and the cathode. After the brush anodization, the thermal spray may be applied over the brush anodized area, or a slightly larger area, or over the entire relevant surface of the component. Similarly, brush anodizations may be associated with weld repairs to anodize the welded material and any other adjacent material from which coating has been removed.

One or more cleaning (chemical, mechanical, and/or mere rinsing), drying, and/or surface treatment (e.g., etching) stages may follow. For example, the anodized substrate may be dried 222 (e.g., dried with filtered hot air or other clear gas). The dried anodized layer may be roughened 226 (e.g., via a light abrasive blast, by etching, or by scuffing such as with an abrasive pad or abrasive paper) to provide a surface sufficiently rough to accept thermally sprayed oxide powder. In other variations, the anodization process 220 may be effective to provide desired roughness. The roughness parameters are subject to some degree of control by modulating anodization properties including additives and the current levels.

The aluminum oxide layer may then be applied 230. Exemplary application comprises a thermal spray process. Exemplary thermal spray is of an aluminum oxide powder such as a fused $Al_2O_3$—$3TiO_2$.

One or more cleaning (chemical, mechanical, and/or mere rinsing) and/or surface treatment (e.g., etching) stages 232 may follow. An exemplary blade tip surface is left as-is. Alternative surfaces (e.g., a V-groove) may be subject to a polishing 240 (e.g., a brush polish).

The use of "first", "second", and the like in the following claims is for differentiation only and does not necessarily indicate relative or absolute importance or temporal order. Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic blade configuration, details of such configuration or its associated engine may influence details of particular implementations. Accordingly, other embodiments are within the scope of the following claims.

What is claimed is:

1. A blade (100) comprising:

an airfoil (106) having a leading edge (114), a trailing edge (116), a pressure side (118), and a suction side (120) and extending from an inboard end (110) to a tip (112); and an attachment root (108), wherein:

the blade comprises an aluminum or aluminum alloy substrate (102) and a coating (130) at the tip (112); and the coating (130) comprises an anodic layer (160) atop the substrate and an aluminum oxide layer (162) atop the anodic layer.

2. The blade of claim 1 wherein:

the substrate is an outer layer and the blade further has an inner layer.

3. The blade of claim 1 wherein:

the substrate comprises 7XXX or 2XXX-series;

the anodic layer has a characteristic thickness ($T_1$) of at least 10 micrometers; and the aluminum oxide layer has a characteristic thickness ($T_2$) of at least 50 micrometers and has lower density and greater porosity than the anodic layer.

4. The blade of claim 1 wherein:

the anodic layer has a characteristic thickness ($T_1$) of 25-75 micrometers; and the aluminum oxide layer has a characteristic thickness ($T_2$) of 75-400 micrometers.

5. The blade of claim 1 wherein:

the airfoil has an erosion coating (104) away from the tip.

6. The blade of claim 1 wherein:

the coating consists of the aluminum oxide layer (162) and the anodic layer (160).

7. The blade of claim 1 wherein:

the aluminum oxide layer (162) is directly atop the anodic layer (160); and the anodic layer (160) is directly atop the substrate (102).

8. A method for manufacturing the blade of claim 1, the method comprising:

applying (220) the anodic layer (160); and applying (230) the aluminum oxide layer (162).

9. The method of claim 8 wherein:

the applying the anodic layer comprises a hard anodize; and the applying the aluminum oxide layer comprises spraying.

10. The method of claim 8 wherein:

the applying the anodic layer comprises a hard anodize; and the applying the aluminum oxide layer comprises thermal spraying.

11. The method of claim 10 wherein:

the thermal spraying comprises plasma spraying.

12. The method of claim 8 further comprising:

peening (210) performed prior to applying the anodic layer.

13. A method comprising:

providing an aluminum alloy substrate (102);

anodic coating (220) the substrate; and thermal spraying (230) an aluminum oxide layer atop the anodic layer.

14. The method of claim 13 wherein:

the substrate is a gas turbine engine component (100).

15. The method of claim 13 wherein:

the anodic coating comprises a brush anodizing.

16. The method of claim 15 wherein:

the brush anodizing is a local anodizing of a repair region.

* * * * *